US010118746B2

(12) United States Patent
Allika et al.

(10) Patent No.: US 10,118,746 B2
(45) Date of Patent: Nov. 6, 2018

(54) TOPPER FOR A CONTAINER

(71) Applicants: Danone S.A., Barcelona (ES); Compagnie Gervais Danone, Paris (FR)

(72) Inventors: Sergi Fernandez Allika, Barcelona (ES); Pedro Galera Sanchez, Alicante (ES); Frederic Chivrac, Paris (FR)

(73) Assignees: Danone S.A. (ES); Compagnie Gervais Danone (FR)

( * ) Notice: Subject to any disclaimer, the term of this patent is extended or adjusted under 35 U.S.C. 154(b) by 0 days.

(21) Appl. No.: 15/109,000

(22) PCT Filed: Dec. 31, 2014

(86) PCT No.: PCT/EP2014/079500
§ 371 (c)(1),
(2) Date: Jun. 29, 2016

(87) PCT Pub. No.: WO2015/101654
PCT Pub. Date: Jul. 9, 2015

(65) Prior Publication Data

US 2016/0325893 A1 Nov. 10, 2016

(30) Foreign Application Priority Data

Dec. 31, 2013 (WO) ..... PCT/EP2013/078164

(51) Int. Cl.
*B65D 51/22* (2006.01)
*B65D 47/32* (2006.01)
(Continued)

(52) U.S. Cl.
CPC ..... *B65D 51/225* (2013.01); *B65D 47/32* (2013.01); *B65D 51/22* (2013.01); *B65D 51/222* (2013.01);
(Continued)

(58) Field of Classification Search
CPC .... B65D 51/225; B65D 51/222; B65D 51/22; B65D 51/224; B65D 47/32; B65D 85/80;
(Continued)

(56) References Cited

U.S. PATENT DOCUMENTS 2,660,781 A * 12/1953 Harms ..... B67B 7/26 220/278
2003/0218017 A1* 11/2003 Schmidtner ..... B65D 43/0222 220/254.5
(Continued)

FOREIGN PATENT DOCUMENTS

ES 1079052 U 4/2013
JP 2003327266 A 11/2003
(Continued)

OTHER PUBLICATIONS

Translation of JP 2005022757 (Hiromitsu et al.), Jan. 27, 2005.*
(Continued)

*Primary Examiner* — Robert J Hicks
(74) *Attorney, Agent, or Firm* — Lerner, David, Littenberg, Krumholz & Mentlik, LLP

(57) ABSTRACT

A topper for a container having an upper surface is presented. The topper includes: a body adapted to engage an upper surface of the container, and a movable perforation platform having at least one protruding perforating element. The perforation platform is pushable with respect to the body from a resting position to a working position wherein the perforating element perforates the upper surface of the container. The perforation platform presents in resting position a first orientation and presents in working position a second orientation, the first and the second orientation differing by an angle of less than 30° . Also, an assembly and a method of using the assembly are presented.

11 Claims, 5 Drawing Sheets

(51) Int. Cl.
*B65D 85/72* (2006.01)
*B65D 85/80* (2006.01)

(52) U.S. Cl.
CPC ..... *B65D 51/224* (2013.01); *B65D 85/72* (2013.01); *B65D 85/80* (2013.01); *B65D 2251/009* (2013.01); *B65D 2251/0018* (2013.01); *B65D 2251/0028* (2013.01); *B65D 2251/0093* (2013.01); *B65D 2543/00083* (2013.01); *B65D 2543/00092* (2013.01); *B65D 2543/00203* (2013.01); *B65D 2543/00296* (2013.01); *B65D 2543/00527* (2013.01); *B65D 2543/00537* (2013.01); *B65D 2543/00648* (2013.01); *B65D 2543/00685* (2013.01); *B65D 2543/00759* (2013.01); *B65D 2543/00796* (2013.01)

(58) Field of Classification Search
CPC .. B65D 85/72; B65B 69/0033; B65B 69/0041
USPC .... 220/265, 713, 711, 278, 277, 266, 254.3, 220/254.1, 259.1, 256.1, 258.4, 258.3, 220/258.1; 229/404, 400; 53/492; 215/297, 301, 302
See application file for complete search history.

(56) References Cited

U.S. PATENT DOCUMENTS

| | | | | |
|---|---|---|---|---|
| 2014/0048549 | A1 | 2/2014 | Wille | |
| 2015/0083724 | A1* | 3/2015 | Lagace ..... | B65D 47/0847 220/258.4 |

FOREIGN PATENT DOCUMENTS

| | | | |
|---|---|---|---|
| JP | 2004123155 | A | 4/2004 |
| JP | 2005022757 | A | 1/2005 |
| JP | 2009179348 | A | 8/2009 |
| JP | 2011230828 | A | 11/2011 |
| WO | 2009022745 | A1 | 2/2009 |
| WO | 2012110335 | A1 | 8/2012 |

OTHER PUBLICATIONS

Translation of ES 1079052 (Danone), Apr. 22, 2013.*
International Search Report for International Patent Application No. PCT/EP2014/079501 dated Mar. 10, 2015.
International Search Report for International Patent Application No. PCT/EP2014/079500 dated Mar. 10, 2015.

* cited by examiner

TOPPER FOR A CONTAINER

CROSS REFERENCE TO RELATED APPLICATIONS

The present application is a national phase entry under 35 U.S.C. § 371 of International Application No. PCT EP2014/079500, filed on Dec. 31, 2014, published in English, which claims priority from PCT Application No. PCT/EP2013/078164 filed Dec. 31, 2013, the disclosures of which are incorporated by reference herein.

FIELD OF THE INVENTION

The invention generally concerns sealed containers, in particular containers for liquids, for example beverages.

More precisely, the invention relates to a topper for such a sealed container.

BACKGROUND OF THE INVENTION

Yogurt is a milk based product which is eaten using a spoon or drunk.

Drinkable yogurts, as well as various beverages, are generally sold in containers such as small plastic bottles comprising a neck, sealed with a lid or a screwed cap. The seal or cap is to be removed by a user to drink the content of the bottle.

However, the operation of removing the lid is generally impractical, as the lid is glued to a flange of the container, and the liquid content may be spilled when removing the lid. This operation can be even more critical if a container has a large opening, for example if the container is a cup.

Instead of removing the lid, it has been proposed to only pierce it so as to drink through the created opening, similarly to how it could be performed with a straw. Therefore, the beverage can be easily drunk everywhere and in any circumstances, including when walking or when having only one free hand.

The Utility Model ES 1079052 describes a flat accessory with a perforation funnel which can be applied to a container for perforating it. A hole in the accessory enables drinking through the opening consequently created within the lid. Such accessory is efficient, but it requires being manually placed on the lid at first, and then carefully handled by the user, which is detrimental for the handiness of the product. Furthermore, the accessory may be lost.

The patent applications JP2004123155 and JP2003327266 disclose two accessories for containers, each presenting a moveable part with a cutting edge. These accessories must securely engage the container before using the edge, which improves their reliability. However such accessories still require inconvenient manual handling. Moreover, these accessories are complex, bulky and expensive.

Besides, all said known perforation accessories may create excessively large openings in the container if handled without the necessary caution, and the beverage may be spilled.

In view of these drawbacks, there is a need for an improved container accessory with is simpler, cheaper, handier, while allowing good control of the perforation.

SUMMARY OF THE INVENTION

The present invention proposes in a first aspect a topper for a container having an upper surface, the topper including:

- a body adapted to engage an upper surface (10) of the container, and
- a movable perforation platform having at least one protruding perforating element, the perforation platform being movable with respect to the body between:
  - a resting position, and
  - a working position wherein the perforating element perforates the upper surface of the container, wherein the perforation platform is held in the resting position by at least one breakable portion connecting the perforation platform to the body.

Preferred but non-limiting features of the present invention are as follows:

- the body includes a top part and a skirt, the skirt being adapted to engage the upper surface of the container, and the perforation platform being connected to the top part;
- when the skirt engages the upper surface of the container, the skirt defines a inner recess extending between the top part and the upper surface, the perforating element fitting in said inner recess when in resting position;
- the perforation platform is further connected to the top part though at least one hinge;
- the perforation platform is connected to a joint part by a first hinge, and the joint part is connected to the top part by a second hinge;
- the hinge is located at a distal end of an arm protruding from the top part in said inner recess;
- the perforation platform and the at least one breakable portion are integral to the top part;
- the top part is at least partially covered by a sticker at least hiding the perforation platform;
- the perforation platform further comprises at least one orifice cooperating with the perforating element when the perforating element perforates the upper surface of the container;
- the perforation platform comprises two perforation elements and two corresponding orifices.

The present invention proposes in a second aspect an assembly including a topper according to the first aspect and a container, wherein the topper engages an upper surface of the container.

Preferred but non-limiting features are as follows:

- the upper surface of the container comprises a lid sealing the container, the lid being perforated by the perforating element when the perforation tab is in working position;
- the at least one breakable portion of the topper is adapted to break when a force sufficient for the perforation element to perforate said lid is applied on the perforation platform, so as to enable the perforation element to perforate the lid;
- the container is filled with a liquid, for example edible or drinkable liquid, preferably a beverage, preferably a milk-based liquid composition.

The present invention proposes in a third aspect a method of using the assembly according to the second aspect, the method including steps of:

- moving the perforation platform from the resting position to the working position;
- pouring the liquid filled in the container through the orifice.

BRIEF DESCRIPTION OF THE DRAWINGS

The above, and other objects, features and advantages of this invention, will be apparent in the following detailed description which is to be read in connection with the accompanying drawings wherein.

DETAILED DESCRIPTION OF THE INVENTION

Figure 1A:
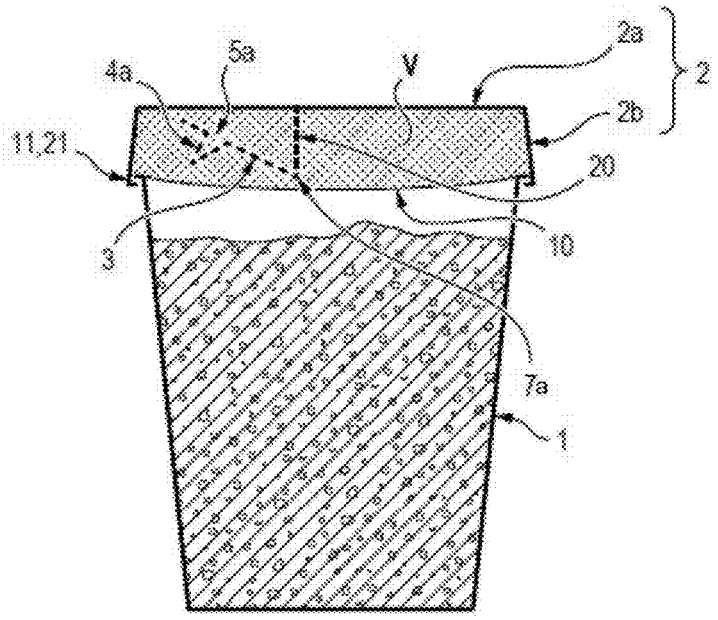
FIGS. 1*a-b* are schematic views of a transversal section of an assembly of a container and a topper according to a first embodiment the invention in a resting position and a working position.

With reference to FIGS. 1, 2 and 3, the invention proposes a topper 2 for a container 1 having an upper surface 10.

The container 1 is for example a substantially cylindrical (and/or slightly conical) hollow piece made of glass, carton or plastic, in particular, polystyrene (PS), polypropylene (PP), polyethylene (PE), polylactic acid (PLA). As it will be explained, the upper surface 10 is intended to be perforated. This upper part 10 preferably includes a lid sealing the container 1, the lid being for example made of aluminium, paper, plastic, or an association thereof.

The container 1 may have a drinking glass shape or yogurt cup shape. The container may thus comprise an opening, which is to be covered by the upper surface (10), a bottom, and side walls. The opening and/or the side walls can have, horizontally a square cross section or a square with rounded corners cross section, or round cross section or an oval cross section. The walls might form a cylinder shape or conical shape The walls (perpendicular to the cross section) may be provided with elements such as stickers or banderoles. Elements such as banderoles can contribute to re-enforcing the mechanical resistance of the container. The largest dimension of the cross section, for example the diameter of the cross section is circular, of the opening is herein referred to as "D" or "width". The height of the walls is herein referred to as "H". In some embodiments $0.5H \leq D \leq H$. In some embodiment $0.5D \leq H \leq D$. In one embodiment the container does not present a neck with a narrowed opening compared to the side walls cross section. In another embodiment the container has a bottle shape with a neck.

The container 1 can be filled with a liquid, preferably a milk-based composition. The liquid in the container 1 can be any liquid, for example an edible or drinkable liquid, often referred to as foods liquids. It can be for example a sauce, a soup or a beverage: herein beverage include waters, juices, sodas, milk-based compositions such as milk, optionally flavored, and fermented milk products, for example yogurt or kefir.

The container may be for example a container of 50 ml (or 50 g), to 1 L (or 1 kg), for example a container of 50 ml (or 50 g) to 80 ml (or 80 g), or 80 ml (or 80 g) to 100 ml (or 100 g), or 100 ml (or 100 g) to 125 ml (or 125 g), or 125 ml (or 125 g) to 150 ml (or 150 g), or 150 ml (or 150 g) to 200 ml (or 200 g), or 250 ml (or 250 g) to 300 ml (or 300 g), or 300 ml (or 300 g) to 500 ml (or 500 g), or 500 ml (or 500 g) to 750 ml (or 750 g), or 750 ml (or 750 g) to 1 L (or 1 kg).

It is to be understood that the skilled person would know how to adapt the topper according to the invention to any container 1 having an upper surface 10.

In the exemplary embodiment represented by figures, the container 1 is 85 mm tall (H=85 mm), 65 mm wide (D=65 mm).

The topper 2 is for instance a piece crowning the container 1. It can be made of a similar or different plastic material as container 1, for example polystyrene (PS), polypropylene (PP), polyethylene (PE), polylactic acid (PLA). PP is found to present a good flexibility and breakability compromise. In other words, the topper 2 includes a body adapted to engage the upper surface 10 of the container 1, in particular in a secure way.

Figure 2A:
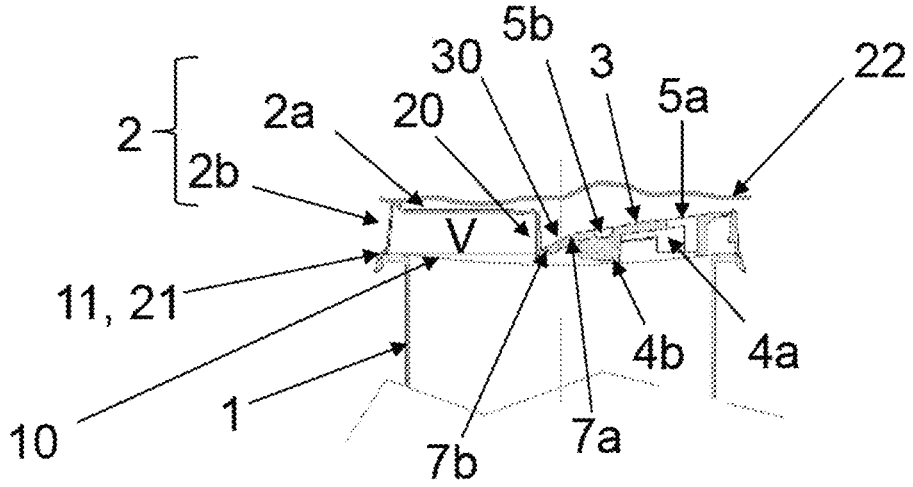
FIGS. 2*a-d* are schematic views of a transversal section of an assembly of a container and a topper according to a second embodiment of the invention in a resting position and a working position.

As it can be seen on FIG. 1*a* or 2*a*, the body includes a top part 2*a* and a skirt 2*b*, wherein the skirt 2*b* engages the upper surface 10 of the container 1. The top part 2*a* can be a flat part, and the skirt 2*b* can be cylindrically shaped. Thus, a reverse cross-section of the topper 2 is "U"-shaped.

The upper surface 10 is preferably engaged according to its periphery. In other words, by engaging it is meant cooperating with this periphery of this upper surface 10 so as to assemble the container 1 and the topper 2.

Thus, in the example of FIG. 1*a* or 2*a*, the skirt 2*b* includes at least one tab 21 which protrudes from the inner surface of the skirt 2*b* and extends radially towards the center of the topper 2. This tab 21 cooperates with at least one further tab 11 protruding from the edge of the container 1 (i.e. at the periphery of the upper surface 10), said further tab 11 extending radially toward the exterior of the container 1. When the upper surface 10 of the container 1 engages the topper 2 due to a translation movement of the container 1, the skirt 2*b* deforms (in particular through an elastic deformation) until the tabs 11 of the container 1 reach beyond the tabs 21 of the skirt 2*b*, so as to "clip" the topper 2 on the container 1.

When the skirt 2*a* engages the upper surface 10, the skirt 2*b* defines an inner recess V (in particular a cylindrical volume) between the top part 2*a* and the container 1. In the exemplary embodiment, the topper 2 is 12 mm tall, and the inner recess V defined is nearly 8 mm deep.

Perforation Platform

Figure 3A:
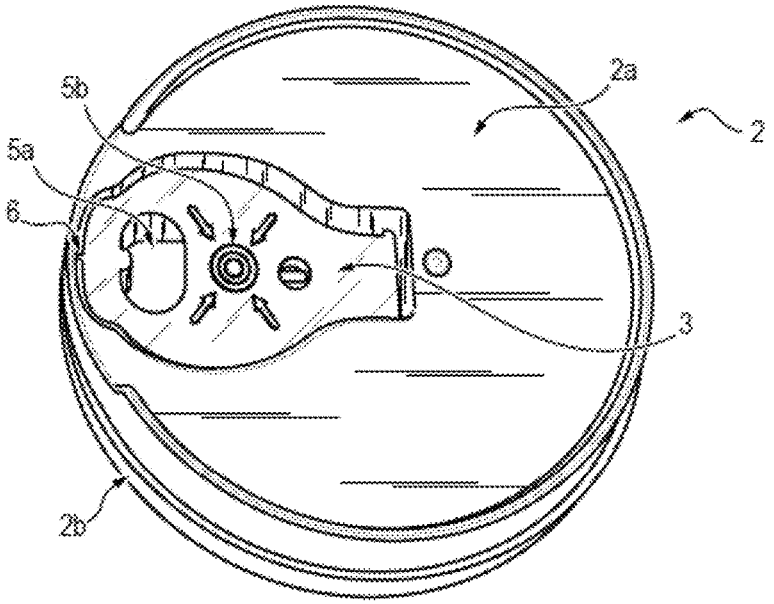
FIGS. 3*a-c* are views under different angles of embodiments of a topper according to the invention.

The topper 2 is provided with a movable perforation platform 3 having at least one protruding perforating element 4*a*, 4*b*. As represented by FIG. 3*a*, this perforation platform 3 is connected (directly or not, at it will be explained) to the top part 2*a*.

The perforation platform 3 includes at least one orifice 5*a*, 5*b*, preferably a main orifice 5*a* and an auxiliary orifice 5*b*. The main orifice 5*a* is a drinking orifice, and the auxiliary orifice 5*b* is a breathing orifice (it allows air entrance within the container 1 to replace the drunk liquid).

The perforation platform 3 is movable with respect to the top part 2*a* between a resting position and a working position in which the perforating element 4*a*, 4*b* perforates the upper surface 10 of the container 1.

When the perforation platform 3 has two orifices 5*a*, 5*b*, the perforation platforms 3 has two corresponding perforating elements 4*a*, 4*b*. Each perforating element 4*a*, 4*b* cooperates with an orifice 5*a*, 5*b* so as to create an opening lined up with the orifice 5*a*, 5*b* in the upper surface 10 when perforated. In others words, when the perforation platform 3 is in working position, fluidic connection is enabled between the inside and the outside of the container 1 through the perforated upper surface 10 and the perforation platform (via orifices 5*a*, 5*b*).

Figure 3B:
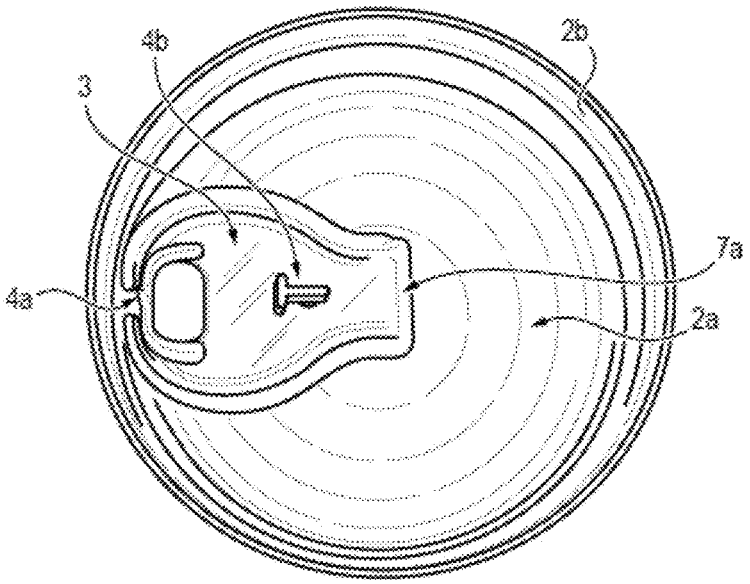
Figure 3C:
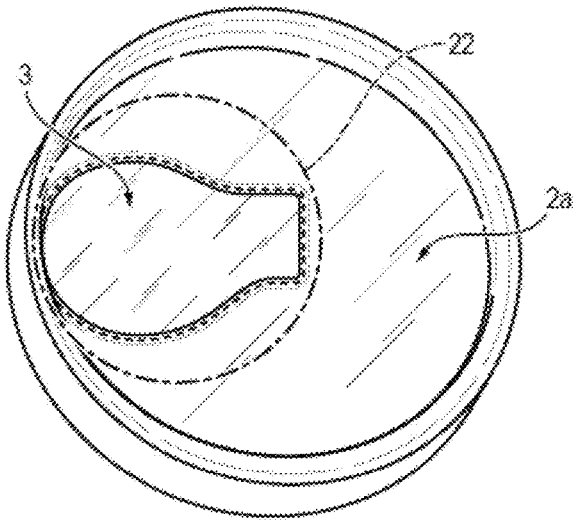

FIG. 3*b* represents examples of perforating elements 4*a*, 4*b*. In particular, both perforating elements 4*a* and 4*b* can be sharp pieces of various shapes. In FIG. 3*b*, the main piercing element 4*a* (cooperating with the main orifice 5*a*) is U-shaped, and the auxiliary piercing element 4*b* (cooperating with the auxiliary orifice 5*a*) is H-shaped.

Figure 1B:
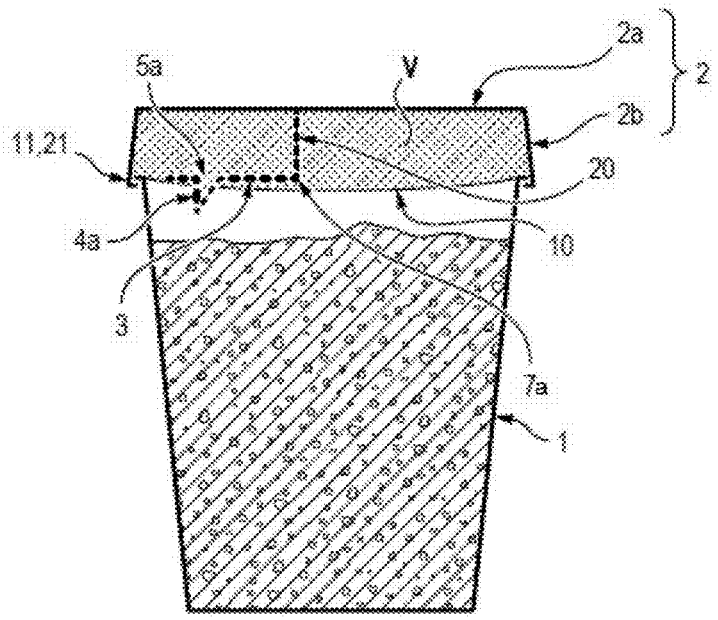
Figure 2B:
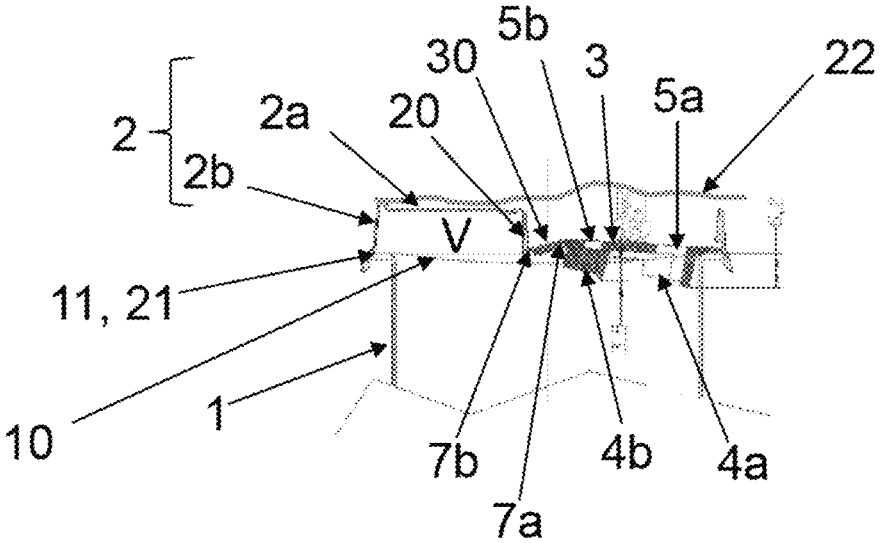
Figure 2C:
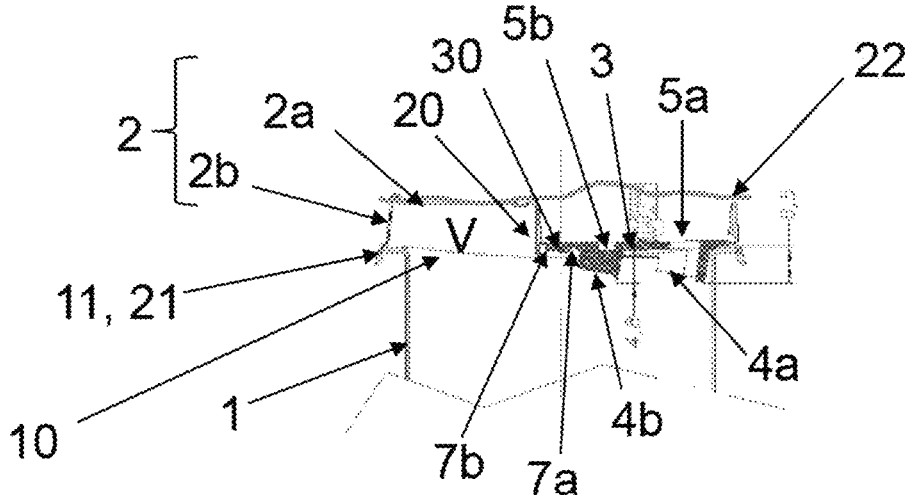
Figure 2D:
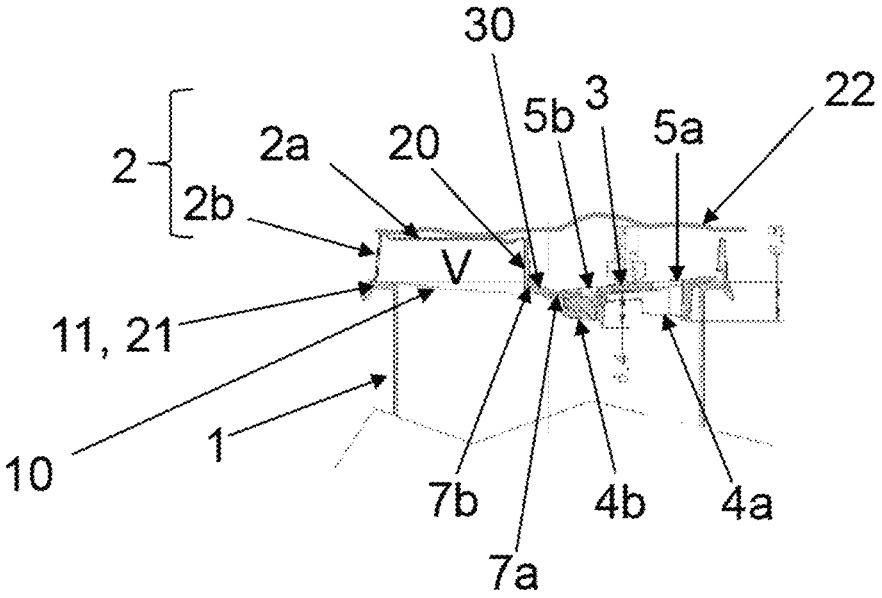

On the first embodiment, the resting position is represented on FIG. 1*a,* and the working position is represented on FIG. 1*b.* On the second embodiment, the resting position is represented on FIG. 2*a*, and the working position is represented on FIG. 2*d* (FIGS. 2*b* and 2*c* represents intermediate positions). As it can be seen, the resting position is an "up" position, while the working position is a "down" position.

In these examples, the movement for switching to working position comprises a rotation of the perforation platform 3 according to an axis sensibly parallel to the top part 2*a* (by approximately 12° in the exemplary embodiment of FIG. 1*a*). At least one hinge 7*a* connecting the perforation platform 3 to the top part 2*a* (optionally via an arm 20, as it will be explained later) allows this rotation.

In the exemplary embodiment of FIGS. 1*a*-1b, the first hinge 7*a* is the only hinge, and therefore the aforementioned rotation is the only one. By contrast, the exemplary embodiment of FIGS. 2*a*-2*d* presents another hinge 7*b.* In this embodiment, the top part 2*a* is connected to the perforation platform 3 through a joint part 30. More precisely, the perforation platform 3 is connected to a joint part 30 by the first hinge 7*a,* and the joint part 30 is connected to the top part 2*a* by a second hinge 7*b.* The joint part 30 can be seen as an extension of the perforating platform 3, which only acts as an articulation enabling the global movement of the perforation platform 3 to be closer to a translation than a rotation.

To this end, the first and the second hinges 7*a,* 7*b* advantageously present parallel axis. It is to be noted that it is possible to have more than two hinges (and consequently more than one joint part 30).

As it can be seen in FIG. 2*b* the movement for switching to working position begins in this embodiment with only rotation according to the first hinge 7*a,* up to the perforating element 4*a,* 4*b* (and especially the first perforating element 4*a*) perforating the upper surface 10, and a distal end of the perforation platform 3 touching the container 1. At this point, the joint part 30 and the perforation platform 3 are not lined up, i.e. the hinge 7*b* defines an angle inferior to 180° so as to slightly protrude.

If the movement continues, the second hinge 7*b* begins to operate (as the distal end of the perforation platform 3 already touches the container 1, an exclusive rotation according to the first hinge 7*a* is no more possible) so as to open the angle between the joint part 30 and the perforation platform 3. The second perforating element 4*b* continues perforating the upper surface 10. The angle between the joint part 30 and the perforation platform 3 reaches 180° (see FIG. 4*c*).

If the movement still continues, the angle between the joint part 30 and the perforation platform 3 exceeds 180° (see FIG. 4*d*), i.e. the angle starts to open inwards. Therefore, the perforation platform perfectly fits the shape of the upper surface 10, which prevents leaks (see below). Furthermore, this position acts as a self-lock because of the over-180° angle, and these is no risk for the perforation platform 3 to unexpectedly go back to resting position.

To trigger the movement, in the examples of FIGS. 1 and 2 a user just has to press the perforation platform 3 with one finger. The user can for example grasp the container 1 with a hand, and press the perforation platform 3 with the thumb. The applied pressure is transmitted to the perforating elements 5*a,* 5*b,* which consequently perforate the upper surface 10.

In shall be understood that the present invention is not limited to any kind of action for switching from resting position to working position. Alternatively to pushing, some architectures may propose to translate the perforation platform 3, or even pulling it (for example if the perforation platform 3 is linked to the top part 2*a* by a rotation axis arranged between the first and the second openings 5*a,* 5*b* (instead of at least one hinge), pulling the rear part of the perforation platform (near the second opening 5*b*) leads to the first perforating element 4*a* perforating the upper surface 10).

Breakable Portions

Figure 4:
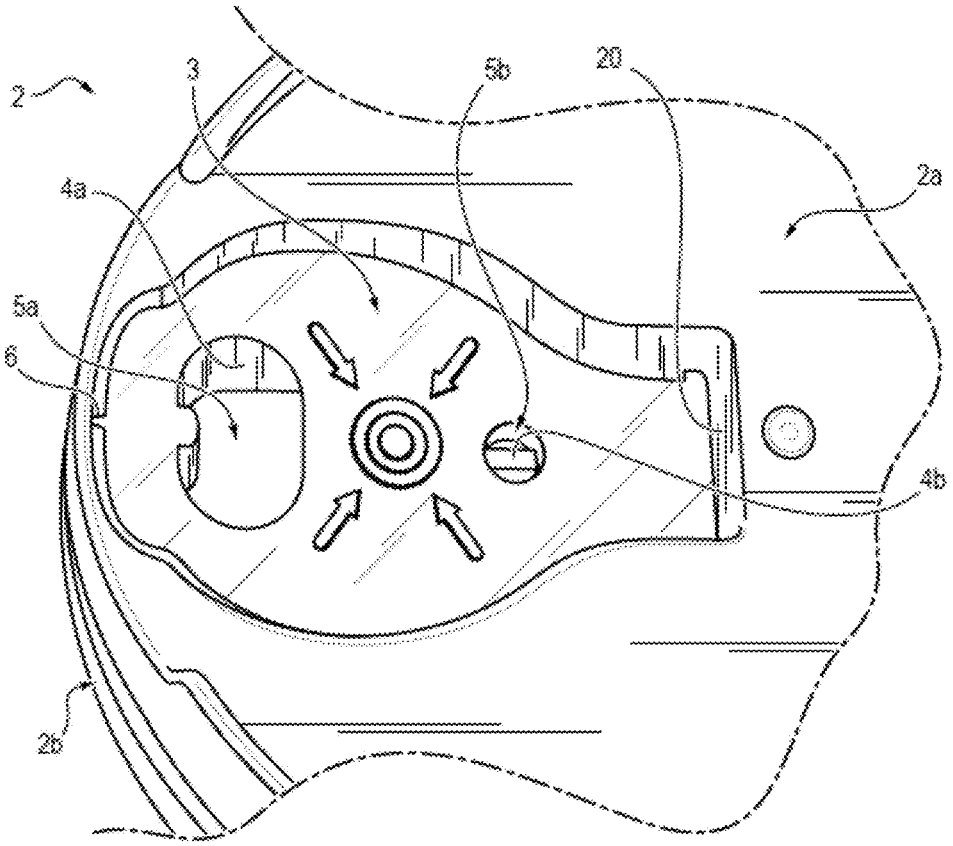
FIG. 4 is a view of a perforation platform of an embodiment of a topper according to the invention.

The perforation platform 3 is further held in the resting position by at least one breakable portion 6 connecting the perforation platform 3 to the topper 2. As represented by FIG. 4, a plurality (six in the example) of breakable portions 6 may be arranged around the perforation platform 3. Alternatively, there may be a single breakable portion, in particular located at the distal end of the perforation platform.

A breakable portion is a physical link between the perforation platform 3 and the top part 2*a* (for instance a thin plastic thread), which is intended to irreparably break when subjected to a force which is above a given threshold.

It has to be understood that even if the whole topper (as any plastic piece) will ultimately break if subjected to a sufficient force, said threshold is far below the breaking point of the top part 2*a,* and sufficiently low for being reachable with the strength of a finger (at the most a few Newtons). In other words, the breakable portions 6 may be seen as "weak points" of the topper 2: if a stress is applied between the perforation platform 3 and the top part 2*a,* the rupture always takes place at the breakable portions 6, and not in the perforation platform 3 or in the top part 2*a*.

The breakable portions 6 have two effects:

in the absence of stresses (i.e. before the user tries to move (by example by pressing) the perforation platform 3), the breakable portions 6 keep the perforation platform 3 in the resting position. There is no risk of accidentally switching to working position and unexpectedly perforating the upper surface 10. In the prior art, the accessory had to be placed on the lid at the very last moment (to avoid unwanted perforation), while in the present invention the topper 2 may be early mounted on the upper surface 10 of the container 1. To this end, the perforating element 4*a,* 4*b* advantageously fits in said inner recess V when the perforation platform 3 is in resting position. In other words, the inner recess V is large enough to contain at least the whole perforation platform 3 (in particular when connected to the top part 2*b*via an arm 20, see after). Therefore, as long as the perforation platform 3 is held in the resting position by the breakable portions 6, the perforating elements 5*a,* 5*b* cannot reach the upper surface 11, while it is protected by the topper 2.

the "overperforation", i.e. perforation with an excessive force creating large openings and leaks, is prevented by such topper. Indeed, the breakable portions 6 break as soon as the given threshold is reached. This threshold can be easily controlled by changing the number of breakable portions 6, their thickness, etc. Therefore, the breakable portions 6 of the topper 2 can be configured so as to break when a force sufficient for the perforating element 4*a,* 4*b* to perforate the upper part 10 of the container 1 is applied on the perforation platform 3. In other words, the threshold can be chosen in function of the resistance of the lid, for example in the range 100-150% of the force needed for the perforating element 3 to perforate the upper part 10 of the container 1. Therefore, the lid (the upper part 10) is effectively pierced without being torn.

It can be noted that the perforating platform 3 may be linked to the top part 2*a* only with breakable portions 6 (i.e. without hinges 7*a*, 7*b* nor axis). In such a configuration, the switching movement of the perforation platform 3 is a full translation. When in working position (after the breakable portions 6 are broken), the perforation platform 3 is physically detached from the top part 2*a*.

Other Improvements of the Topper

Preferably, the perforation platform 3 and the at least one breakable portion 6 are integral to the top part 2*a*. The limit between the perforation portion 3 and the top part 2*a* thus forms a "dotted line", the dots of which are the breakable portions 6 spaced apart one from the other. Further, the hinge(s) 7*a*, 7*b* is(are) also integral to the top part 2*a*.

The whole topper 2 can therefore be cast in one piece (for example of polypropylene). The cost and the production time are therefore greatly reduced.

Moreover, the first hinge 7*a* is preferably located at a distal end of an arm 20 protruding from the top part 2*a* through said inner recess V, so as to bring this first hinge 7*a* close to the upper surface 10. Preferably, the distal part of the arm 20 comes to contact the upper surface 10, as represented on FIGS. 1 and 2. Thanks to this arm 20, the perforation platform 3 (and the joint part 30 if there is one) presents an inclination when in the resting position, and becomes horizontal when moved in the working position, therefore fitting the shape of the upper surface 10 (see FIG. 1*b*), so as to have the orifices 5*a*, 5*b* contact the openings created by the perforating elements 4*a*, 4*b*. The risk of leaks is therefore greatly reduced.

To further protect the perforation platform 3, the top part 2*a* may be at least partially covered by a sticker 22 (as represented on FIGS. 2 and 3*c*), so that the sticker 22 hides at least the perforation platform 3. This sticker 22 prevents any contamination of the orifice 5*a*. This sticker 22 acts as a tamper-evident element, as it has to be removed or split by the user before moving the perforation platform 3 into working position. To this end, the sticker 22 may be provided with a dotted line (defining a weakness line) in particular following a contour of the perforation platform 3. Thus, the sticker 22 breaks according to the dotted line when pulled by the user, so as to unveil the perforation platform 3, which can be consequently moved for drinking.

In one embodiment, not represented, a protection lid is provided in the inner part of topper to protect the perforation platform, for example to prevent children from being hurt by the perforating element(s). The protection lid can for example be a disc positioned on a shoulder to the skirt. This protection lid is perforated when the perforation platform in moved to the working position.

Assembly

According to a second aspect, the invention proposes an assembly including a topper 2 as previously described, and a container 1 of which an upper surface 10 is engaged with the topper 2. The upper surface 10 of the container 1 is preferably a lid sealing the container 1.

As already explained, there is no more need to mount the topper only right before perforating the container. The assembly can be sold as such, the perforating platform 3 being held by the breakable portions 6 in the resting position. When a user wishes to drink the liquid inside the container, the user just has to apply a force on the perforation platform 3 up to break the breaking portion 6. It leads to a controlled perforation of the lid 10.

Method

According to a third aspect, the invention proposes a method of using the assembly according to the second aspect of the invention, the method including steps of:

moving (in particular pushing, translating or pulling) the perforation platform 3 from the resting position to the working position (in other words breaking the breaking portions 6);

pouring the liquid filled in the container 1 through the orifice 5*a* (and the opening created in the upper part 10 of the container 1 by the perforating element 4*a*).

The invention claimed is:

1. A topper for a container having an upper surface, the topper including:

a body adapted to engage the upper surface of the container, said body having a top part, wherein the body includes a skirt, the skirt being adapted to engage the upper surface of the container and to define an inner recess extending between the top part and the upper surface, the topper further including a movable perforation platform having at least one protruding perforating element, the perforation platform being connected to the top part, the perforation platform being movable with respect to the body between:

a resting position, the perforating element fitting in the inner recess when in the resting position, and a working position wherein the perforating element perforates the upper surface of the container, wherein the perforation platform is held in the resting position by at least one breakable portion linking the perforation platform to the body, said breakable portion being intended to break when a stress is applied to the perforation platform, and wherein the perforation platform is connected to a joint part by a first hinge, and the joint part is connected to the top part by a second hinge.

2. A topper according to claim 1, wherein the second hinge is located at a distal end of an arm which extends from the top part and which is configured to extend towards the upper surface of the container through said inner recess.

3. A topper according to claim 1, wherein the perforation platform and the at least one breakable portion are integral to the top part.

4. A topper according to claim 1, wherein the top part is at least partially covered by a sticker at least hiding the perforation platform.

5. A topper according to claim 1, wherein the perforation platform further includes at least one orifice cooperating with the perforating element when the perforating element perforates the upper surface of the container.

6. A topper according to claim 5, wherein the perforation platform includes two perforation elements and two corresponding orifices.

7. An assembly including a topper according to claim 1 and a container, wherein the topper engages an upper surface of the container.

8. An assembly according to claim 7, wherein the upper surface of the container comprises a lid sealing the container, the lid being perforated by the perforating element when the perforation tab is in the working position.

9. An assembly according to claim 8, wherein the at least one breakable portion of the topper is adapted to break when a force sufficient for the perforation element to perforate said lid is applied on the perforation platform, so as to enable the perforation element to perforate the lid.

10. An assembly according to claim 7, wherein the container is filled with a liquid.

11. Method of using the assembly according to claim 10, the method including steps of:

moving the perforation platform from the resting position to the working position;

pouring the liquid filled in the container through the orifice.

* * * * *